US011148920B2

(12) United States Patent
Dittus

(10) Patent No.: US 11,148,920 B2
(45) Date of Patent: Oct. 19, 2021

(54) AUXILIARY CONTROL STATION FOR AN AERIAL LIFT

(71) Applicant: HAULOTTE GROUP, L'horme (FR)

(72) Inventor: Sebastian Dittus, Morant (FR)

(73) Assignee: Haulotte Group, L'horme (FR)

( * ) Notice: Subject to any disclaimer, the term of this patent is extended or adjusted under 35 U.S.C. 154(b) by 323 days.

(21) Appl. No.: 16/320,051

(22) PCT Filed: Jul. 21, 2017

(86) PCT No.: PCT/FR2017/052010

§ 371 (c)(1),
(2) Date: Jan. 23, 2019

(87) PCT Pub. No.: WO2018/020114

PCT Pub. Date: Feb. 1, 2018

(65) Prior Publication Data

US 2019/0233270 A1 Aug. 1, 2019

(30) Foreign Application Priority Data

Jul. 28, 2016 (FR) ..... 1657284

(51) Int. Cl.

| | |
|---|---|
| ***B66F 11/04*** | (2006.01) |
| ***B66F 9/20*** | (2006.01) |
| ***B66F 17/00*** | (2006.01) |

(52) U.S. Cl.

CPC ..... *B66F 11/046* (2013.01); *B66F 9/20* (2013.01); *B66F 17/006* (2013.01)

(58) Field of Classification Search

CPC ..... B66C 13/18; B66F 11/04; B66F 11/044; B66F 11/46; B66F 9/20

See application file for complete search history.

(56) References Cited

U.S. PATENT DOCUMENTS 2,885,016 A * 5/1959 Ayers ..... B66F 9/07595 180/53.4
4,724,924 A * 2/1988 Breyer ..... B66F 11/044 182/2.8

(Continued)

FOREIGN PATENT DOCUMENTS

| | | | |
|---|---|---|---|
| CN | 103802148 | A | 5/2014 |
| EP | 2 789 786 | A1 | 10/2014 |
| WO | 2016/087282 | A1 | 6/2016 |

*Primary Examiner* — Colleen M Chavchavadze

(74) *Attorney, Agent, or Firm* — 24IP Law Group USA, PLLC; Timothy R DeWitt

(57) ABSTRACT

The aerial work platform comprises a chassis (2), optionally a turret (4) mounted pivotably on the chassis, a mechanism (8) for lifting a work platform that is mounted on the chassis or the turret, and a control station (50) arranged on the chassis (2) or the turret (4). The control station comprises:

members (52) for controlling the lifting mechanism and optionally the rotation of the turret, a validation member (54), the control members (52) being inhibited in the absence of simultaneous actuation of the validation member, and a handle (70).

The mutual arrangement thereof makes it possible to hold the handle (70) and to simultaneously actuate the validation member (54) with a same hand while simultaneously actuating any one of the control members (52) with the other hand.

20 Claims, 7 Drawing Sheets

(56) References Cited

U.S. PATENT DOCUMENTS

| | | | | |
|---|---|---|---|---|
| 5,890,562 | A * | 4/1999 | Bartels | B60N 2/797 187/224 |
| 6,405,114 | B1 * | 6/2002 | Priestley | B66F 17/006 701/50 |
| 7,004,285 | B2 * | 2/2006 | Bailey | B66F 11/046 182/19 |
| 7,306,280 | B1 * | 12/2007 | Kraimer | B66F 9/07504 280/756 |
| 7,543,671 | B2 * | 6/2009 | Donaldson | B66F 11/044 180/209 |
| 9,415,986 | B2 * | 8/2016 | Cummings | B66F 17/006 |
| 9,656,845 | B2 * | 5/2017 | Dittus | B66F 17/006 |
| 10,124,999 | B2 * | 11/2018 | Puszkiewicz | B66F 11/044 |
| 10,427,925 | B2 * | 10/2019 | Xu | B66F 11/046 |
| 10,618,786 | B2 * | 4/2020 | Parot | B66F 17/006 |
| 10,889,478 | B2 * | 1/2021 | Beji | B66F 9/20 |
| 2009/0260920 | A1 * | 10/2009 | Cummings | B66F 11/046 182/18 |
| 2015/0144426 | A1 * | 5/2015 | Hao | B66F 11/04 182/113 |
| 2015/0217981 | A1 * | 8/2015 | Baillargeon | B66F 17/006 182/2.8 |
| 2015/0284219 | A1 * | 10/2015 | McConnell | B60P 3/12 414/680 |
| 2017/0267508 | A1 * | 9/2017 | Huber | B66F 11/044 |
| 2018/0362313 | A1 * | 12/2018 | Bonnefoy | B66F 11/044 |
| 2019/0107861 | A1 * | 4/2019 | Maier | G05G 1/01 |
| 2019/0119090 | A1 * | 4/2019 | Maisonnette | G01V 8/20 |
| 2019/0153779 | A1 * | 5/2019 | Maier | E06C 5/04 |

* cited by examiner

AUXILIARY CONTROL STATION FOR AN AERIAL LIFT

The present invention relates to the field of mobile elevating work platforms for personnel (also designated by the acronym MEWP), also commonly referred to as aerial work platforms. It relates more particularly to an aerial work platform comprising an auxiliary control station making it possible to control it from the ground.

Aerial work platforms are machines intended to enable one or more persons to work at a height. FIGS. 1 and 2 illustrate an example of an aerial work platform 1, respectively in the deployed state in a position of working at height and in the retracted state in a compact transport position. They comprise a work platform 10 designed to receive the persons and materials. The work platform 10 is supported by a lifting mechanism 8 that makes it possible to lift it from a position lowered on the chassis 2 of the aerial work platform to the required working position at a height. In particular, the lifting mechanism may comprise an articulated and/or telescopic arm at the end of which the work platform 10 is mounted and hydraulic jacks for deploying it with respect to the chassis 2.

The lifting mechanism 8 is often arranged on a turret 4 that is mounted so as to pivot about a vertical axis on the chassis 2, which makes it possible to change the orientation of the lifting mechanism 8—and therefore of the platform 10—with respect to the chassis 2. The chassis is generally equipped with wheels 6 or tracks making it possible to move the aerial work platform on the ground. It is usually motorised to allow autonomous movement of the aerial work platform on the ground.

The platform 10 is equipped with a control station 12 enabling an operator on board the platform 10 to cause the movement of the platform in order to reach the required working position.

These aerial work platforms may also comprise an auxiliary control station 20 enabling an operator to control a movement of the aerial work platform from the ground. The auxiliary control station 20 is generally mounted on a lateral side of the chassis 2 or of the turret 4.

One example of an auxiliary control station 20 of the prior art is illustrated in FIG. 3. It comprises a plurality of manually actuated control members 22 in the form of lever pushers enabling each to make the lifting mechanism 8 or the turret 4 to execute at choice a given movement in one direction or a corresponding movement in the opposite direction. For safety reasons, the auxiliary control station does not generally make it possible to cause the movement of an aerial work platform on the ground.

To avoid the risk of unwanted movement, the auxiliary control station 20 often comprises a validation button 24, in this case in the form of another lever-type push button. In other words, the function of the buttons 22 is inhibited in the absence of simultaneous actuation of the validation button 24. The auxiliary control station 20 generally also comprises other members such as a key switch 26 for starting the aerial work platform or an emergency stop button 28, as well as display members.

The applicant has identified a particular problem, unknown until now, in the case where these aerial work platforms are transported on site. This is because, depending on the circumstances, these aerial work platforms are transported by lorry to their work sites, for example a construction site. The aerial work platforms are then in a compact transport position, that is to say the lifting mechanism 8 is in a position completely folded on the chassis 2 or the turret 4, the platform 10 is inclined so as to be positioned under the lifting mechanism 8 and thus to reduce the total length of the machine, and the turret 4 is oriented so that the lifting mechanism 8 is arranged along the longitudinal mid-plane of the chassis 2. This position is illustrated by FIG. 2.

The operation of loading or unloading the aerial work platform onto or from the lorry—referenced 30—generally consists of running it from the ground onto the bed of the lorry or a trailer 31—and vice versa—by means of movable loading ramps 32. For this purpose, the operator on board the platform 10 uses the control station 12 to move the aerial work platform into a position of moving on the ground—illustrated in FIG. 4—in which the lifting mechanism is lowered and enables the operator to remain at the control station 12 on board the platform 10.

Once placed on the lorry, the operator moves the aerial work platform into its compact transport position. On the other hand, before unloading from the lorry, it is once again made to pass into the position of movement on the ground in FIG. 4.

Passage from the position of movement on the ground to the compact transport position—and vice versa—is done by the operator by means of the auxiliary control station 20 since, for this operation, manipulation of the control station 12 is uncomfortable and dangerous because of the tilting and the high inclination of the platform 10 when passing from one to the other: cf. comparatively the position of the platform 10 in FIGS. 2 and 4. To access the auxiliary control station 20, the operator stands at it on the bed or trailer 31 of the lorry 30. One difficulty may lie in the fact that the space available between the aerial work platform 10 and the edge of the bed or trailer 31 is limited so that the operator is balanced precariously when manipulating the members of the auxiliary control station 20. This is all the more the case since he must press on the validation button 24 with one hand and simultaneously press on the control buttons 22 with the other hand, without any possibility of holding on. In the event of imbalance, the operator risks falling from the bed or trailer 31. This difficulty also arises whenever the operator wishes to manoeuvre from his auxiliary control station 20 the aerial work platform loaded on the lorry or trailer 31, independently of the loading or unloading thereof, for example in order to optimise the folding configuration of its lifting mechanism 8 in consideration of the equipment or machines loaded adjacent on the lorry or trailer 31.

One aim of the present invention is to remedy this drawback. For this purpose, the present invention proposes an aerial work platform comprising:

- a chassis,
- optionally a turret mounted pivotably on the chassis,
- a work platform,
- a mechanism for lifting the work platform that is mounted on the chassis or where applicable on the turret, and
- a control station arranged on the chassis or the turret, said control station comprising:
  - manually actuated control members for controlling the lifting mechanism of the work platform and optionally the rotation of the turret,
  - a manually actuated validation member, the control members being inhibited in the absence of simultaneous actuation of the validation member, and
  - a gripping handle, wherein the mutual arrangement of the validation member and of the gripping handle makes it possible to hold the gripping handle and to simultaneously actuate the validation member with the same hand.

By virtue of this design, the operator can effectively hold onto the gripping handle—thus limiting the risk of falling—while simultaneously manipulating the control and validation members, including when he is standing in precarious stability at the control station arranged on the chassis or the turret, at the edge of the bed or trailer of a lorry on which the aerial work platform is loaded.

According to preferred embodiments, the invention comprises one or more of the following features:

- the validation member is a push button;
- the validation member is arranged on the gripping handle;
- the validation member is arranged on the top of the gripping handle towards one end thereof;
- the mutual arrangement of the control members, of the gripping handle and of the validation member enables a same operator to simultaneously hold the gripping handle and to actuate the validation member with one of his hands and to actuate any one of the control members with his other hand;
- all the control members are placed on a same side of the gripping handle;
- the control members are each situated:
  - at a horizontal distance from the validation member that is less than 1.3 m, more preferentially less than 1 m;
  - at a vertical distance from the validation member that is less than 1 m, more preferentially less than 0.7 m, and more preferentially still less than 0.5 m, and
  - at a distance from the validation member that is less than 1.3 m, more preferentially less than 1 m;
- the distance between the validation member and the gripping part of the gripping handle is less than or equal to 10 cm, and more preferentially less than or equal to 6 cm;
- the control station is arranged on a lateral side of the chassis or of the turret; the control station extends substantially vertically;
- the control members are mounted on a console;
- the console is mounted so as to pivot about a vertical axis on the chassis or on the turret so as to make it possible to change the angular position of the console with respect to the chassis or to the turret;
- the validation member and the gripping handle are also mounted on the console;
- the console is mounted so as to slide horizontally on the turret;
- the aerial work platform comprises a device for holding the console in position making it possible to manually select an angular and/or horizontal position of the console with respect to the chassis or to the turret in which the device holds the console;
- the chassis is mounted on running members for moving the aerial work platform on the ground.

Other aspects, features and advantages of the invention will emerge from a reading of the following description of a preferred embodiment of the invention, given by way of example and with reference to the accompanying drawing.

Figure 1:
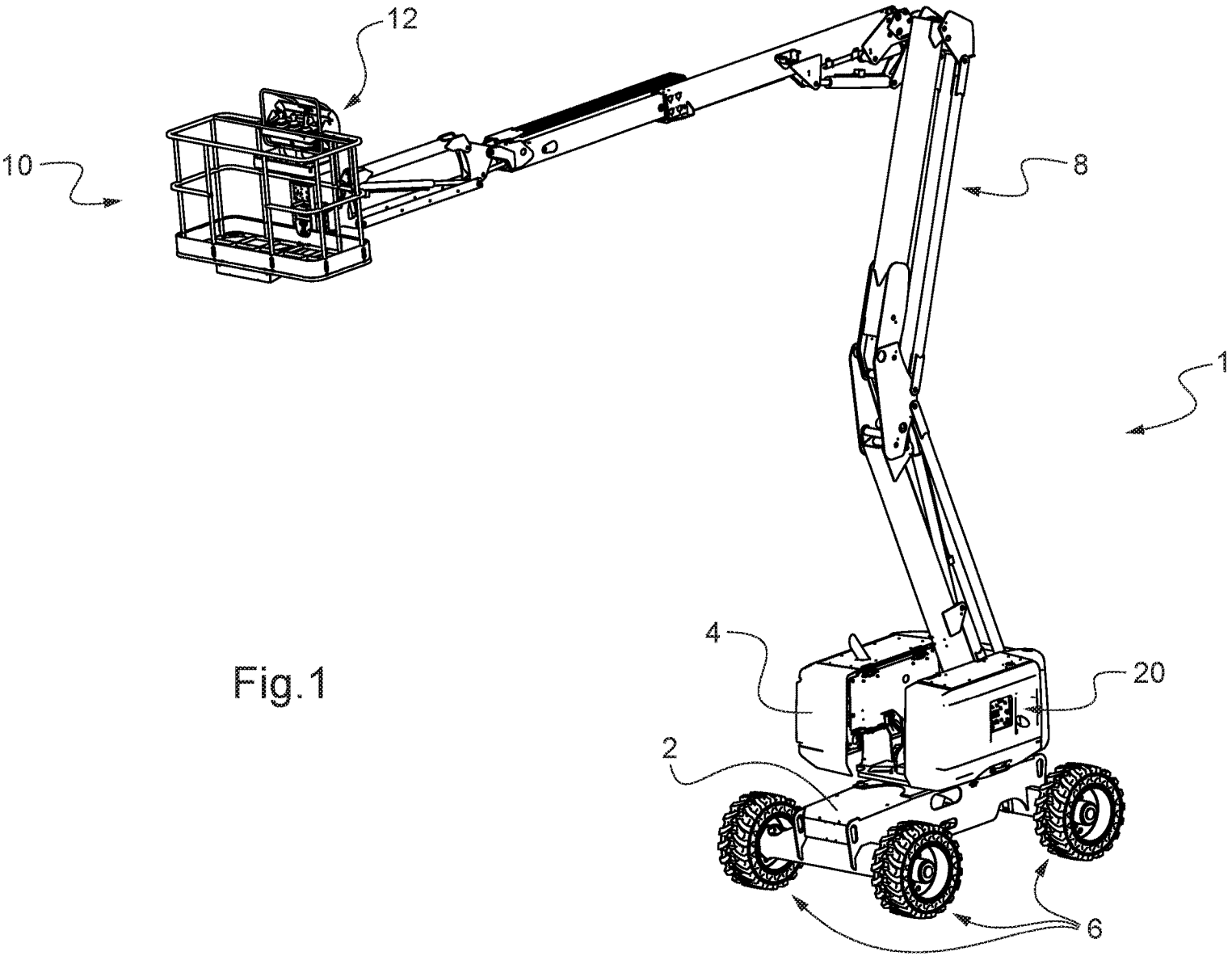
FIGS. 1 and 2 show a perspective view of an aerial work platform, respectively in the deployed state in a working position and in the folded state in the compact transport position.
Figure 2:
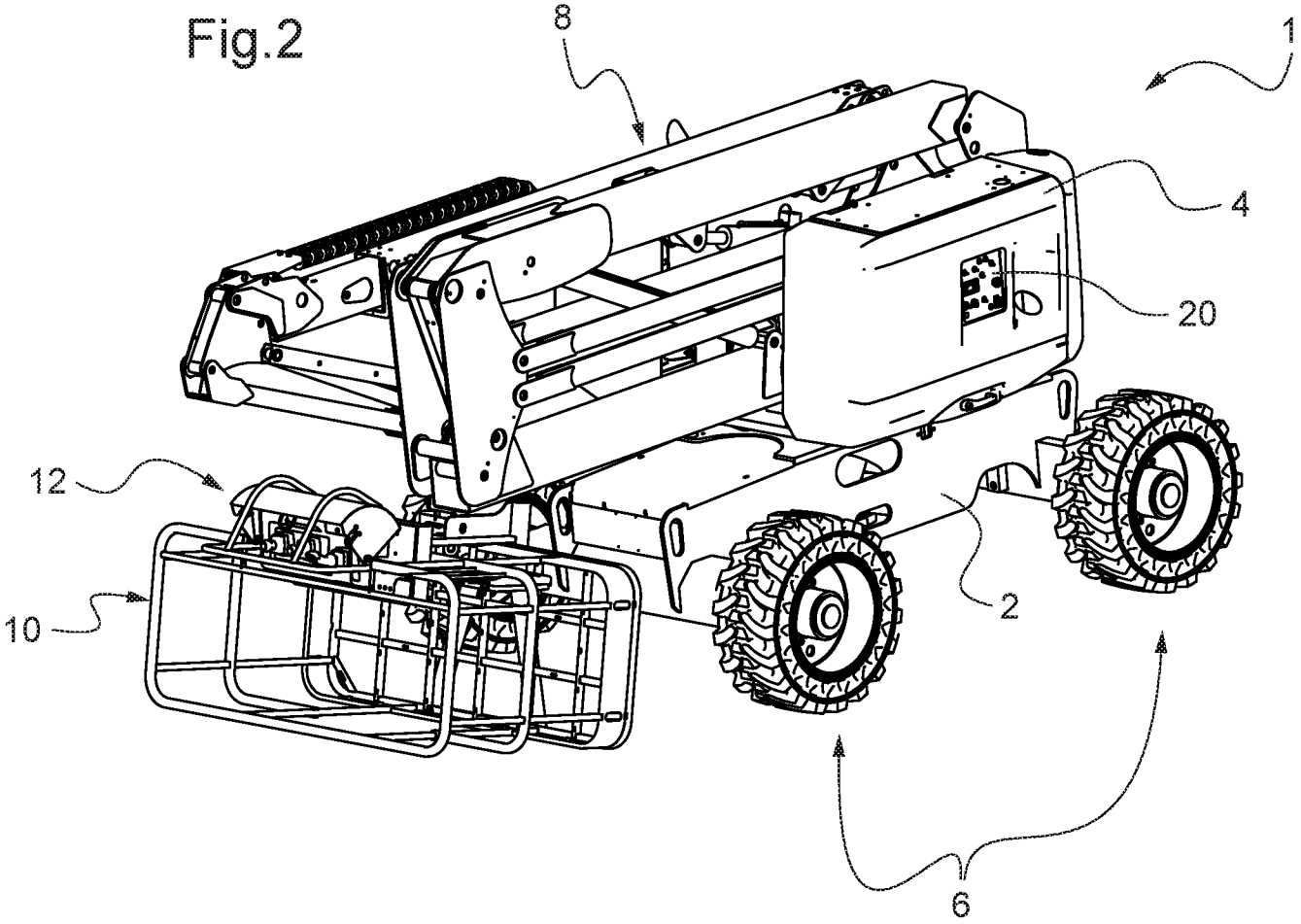
Figure 3:
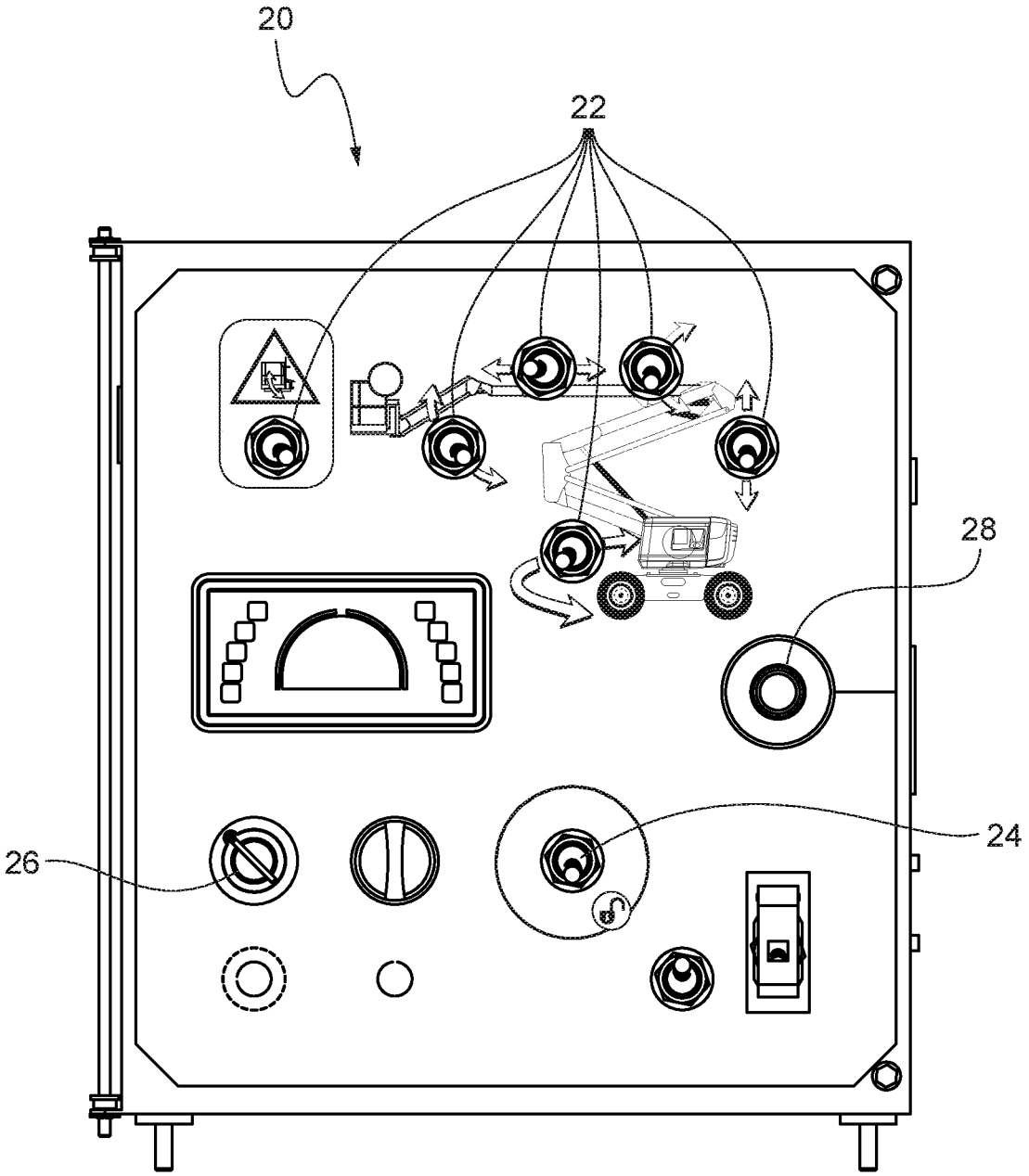
Fig.3 Prior Art
FIG. 3 shows an example of an auxiliary control station of the prior art equipping the turret of an aerial work platform according to FIGS. 1 and 2.
Figure 4:
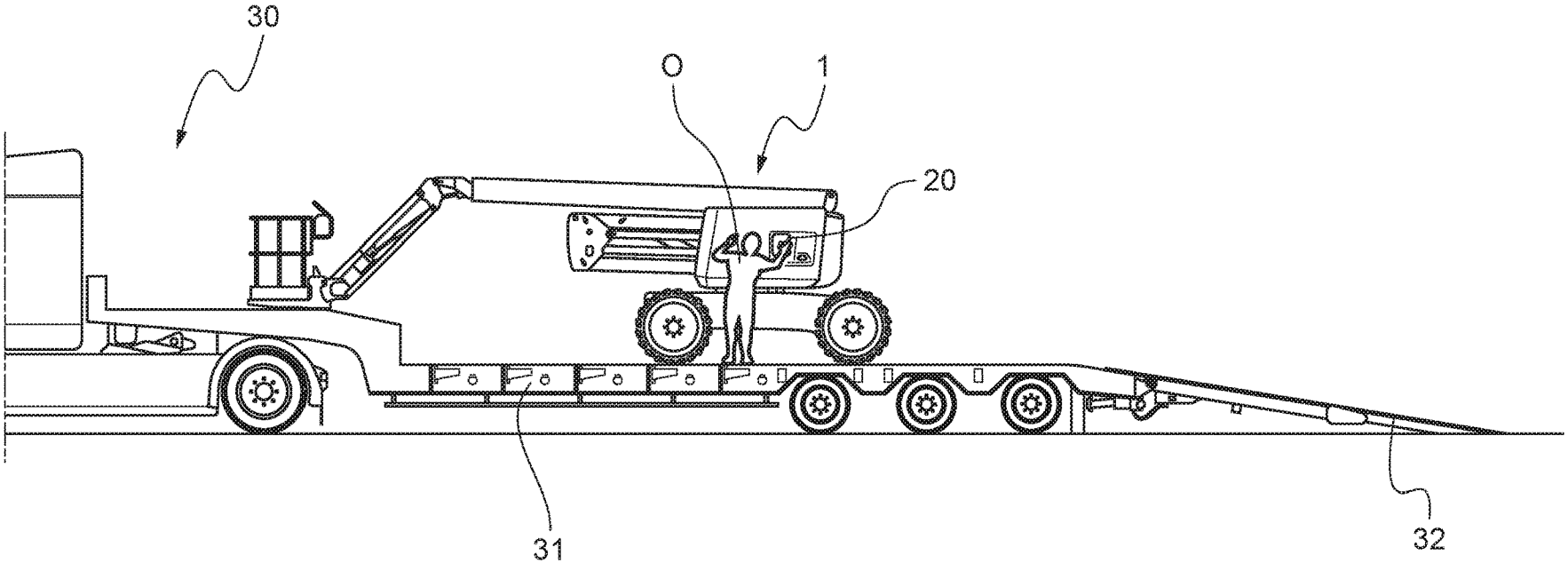
FIG. 4 illustrates the transport of an aerial work platform of FIGS. 1 and 2 on a semi-trailer lorry, as well as an operator on board the semi-trailer at the auxiliary control station of the aerial work platform.
Figure 5:
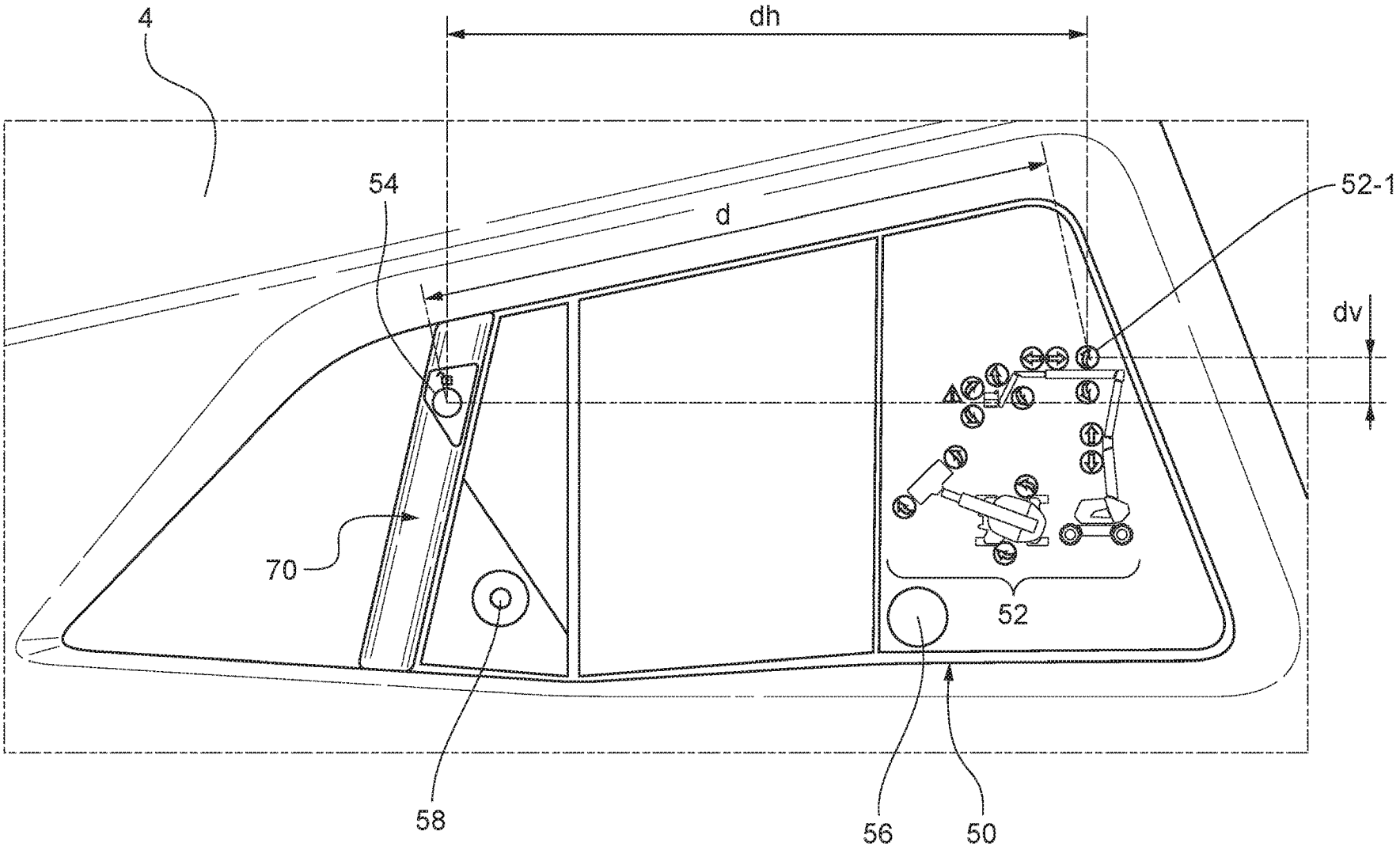
FIG. 5 shows in front view an auxiliary control station according to a preferred embodiment of the invention.
Figure 6:
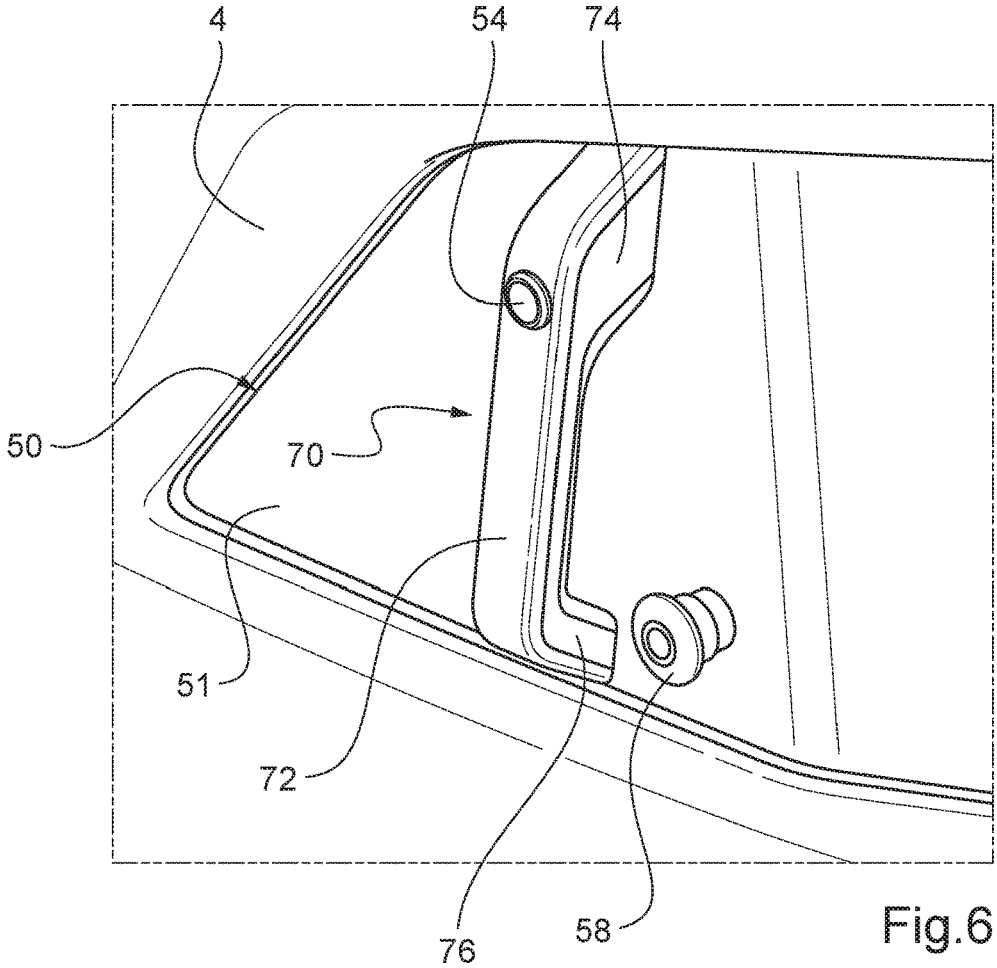
FIG. 6 is a partial perspective view of the auxiliary control station of FIG. 5.
Figure 7:
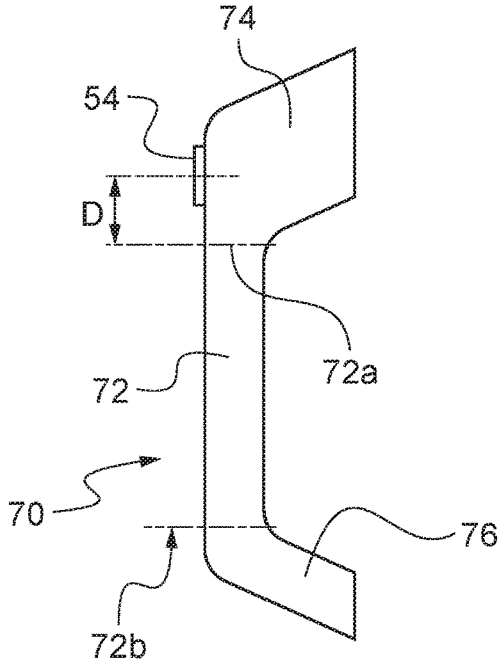
FIG. 7 is a side view of the gripping handle of the auxiliary control station.

With reference to FIGS. 5 to 7, we shall now describe an auxiliary control station 50 according to a preferred embodiment of the invention that is arranged on the turret 4 of the aerial work platform 1 shown in FIGS. 1 and 2 in replacement for the auxiliary control station 20 of the prior art.

It will be understood that the auxiliary control stations according to the invention may be arranged on any type of aerial work platform other than the one illustrated by FIGS. 1 and 2. These are advantageously aerial work platforms with articulated and/or telescopic arm without being limited thereto. They may be provided with a turret 4 or not, it being mentioned that the auxiliary control station is mounted on the chassis 2 or on the turret 4 so as to be arranged at human height from the ground where the aerial work platform is resting, that is to say preferably at less than 1 m 90 from the ground.

The auxiliary control station 50 is preferentially arranged on one side of the turret 4—or according to circumstances of the chassis 2—of the aerial work platform 1. It is preferably a lateral side of the chassis 2 or of the turret 4 according to circumstances, so that the operator can have a better direct view onto the lifting mechanism 8 and the platform 10 in order to control movement thereof more easily. It will be understood that the lateral sides of the chassis 2 and of the turret 4 are defined as being the sides on either side of the longitudinal mid-plane of the chassis 2, the turret 4 being positioned so that the lifting mechanism 8 is in this plane. The auxiliary control station 50 is preferentially arranged vertically at this side of the chassis 2 or of the turret 4. In other words, the various members of the auxiliary control station 50—which will be detailed below—are arranged on a substantially vertical surface.

The auxiliary control station 50 comprises a plurality of manually actuated control members—referenced overall by 52 in FIG. 5, one being specifically designated by the reference 52-1—which make it possible to make the aerial work platform perform movements. More particularly, they make it possible to make the lifting mechanism 8 perform movements in order to move the work platform 10 with respect to the turret 4, or failing this with respect to the chassis 2. Where applicable, they also make it possible to rotate the turret 4 with respect to the chassis 2. In this example, the control members 52 are produced in the form of a membrane keypad, each control member 52 consisting of a keypad key carrying a logo indicating the corresponding movement of the lifting mechanism 8 or of the turret 4 in the event of actuation. Membrane keypads are known per se. It will be understood that the control members 52 may be implemented by any other suitable technology, in particular push buttons or lever pushers 20 mentioned with regard to the prior art.

The auxiliary control station 50 comprises a manually actuated validation member 54. In the absence of actuation of the validation member 54, the control members 52 are inhibited. Thus, in the absence of simultaneous actuation of the validation member 54, actuation of any of the control members 52 does not cause movement of the aerial work platform 1. In other words, for any control member 52 to be able to cause the corresponding movement of the aerial work platform 1, it is necessary to simultaneously actuate the validation member 54. It will be understood that, as soon as manual actuation of the validation member 54 ceases, the control members 52 are once again inhibited.

The auxiliary control station 50 also comprises a gripping handle 70 that is best visible in FIG. 6. The validation member 54 is preferentially mounted on the handle 70. It is arranged so that the operator can hold the handle 70 and simultaneously actuate it with the same one hand. In this case, the validation member 54 is a push button. Advantageously it is mounted on the top of the handle 70 so as to be visible to the operator.

In our example, the handle 70 has a gripping part 72—that is to say the part of the handle 70 that is designed to be gripped with one hand—that is delimited by two notional planes 72*a*, 72*b* visible in FIG. 7, and two end parts 74, 76 for mounting the handle 70. The validation member 54 is in this case arranged on the top of the end part 74. It will be understood that the configuration of the handle 70 may be different. The validation member 54 is positioned so as to be able to be actuated by the thumb while the other fingers of the same hand grip the gripping part 72 of the handle 70. The fact that the other four fingers of the hand can grip the gripping part 72 of the handle 70—independently of the actuation of the validation member 54—allows vigorous gripping of the handle 70 under any circumstances. Moreover, this location of the validation member 54 also enables the operator to actuate it easily without holding the handle 70 if he so desires, for example when he is not in a precarious-stability position. According to the dimensions of the aerial work platform and in particular when the auxiliary control station is mounted on the chassis, the handle 70 can advantageously be positioned at a level enabling an operator to grip it in order to raise himself onto the bed or trailer 51 from the ground.

The validation member 54 can be implemented by any other suitable technology and in any other arrangement with respect to the handle 70. According to a variant, it is implemented in the form of a trigger arranged under the gripping part 72 of the handle 70 and intended to be actuated with the index finger of the hand gripping the 1handle 70. According to another variant, the validation member 54 is arranged not on the handle 70 but adjacent thereto with sufficient proximity to be able to be actuated with one of the fingers—preferably the thumb—of the hand that simultaneously grips the handle 70. It may in particular be a key of the membrane keypad already mentioned with regard to the control members 52.

Whatever the configuration of the handle 70 and the relative arrangement of the validation member 54 and handle 70, it is preferable for the distance D between the validation member 54 and the gripping part 72 of the handle 70 to be less than or equal to 10 cm, and more preferentially less than or equal to 6 cm, which enables an operator of average size to grip the handle 70 and to simultaneously actuate the validation member 54 with the same hand comfortably.

The mutual arrangement of the control members 52, the handle 70 and the validation member 54 is chosen so that the same operator can simultaneously hold the handle 70 and actuate the validation member 54 with one of his hands and actuate any of the control members 52 with his other hand. From this point of view, the control members 52 are preferably each situated at a horizontal distance from the validation member 54 that is less than 1.3 m, more preferentially less than 1 m: in FIG. 5, this horizontal distance is shown and referenced do for the button 52-1. Similarly, the control members 52 are each preferably situated at a vertical distance from the validation member 54 that is less than 1 m, more preferentially less than 0.7 m and more advantageously less than 0.5 m: this vertical distance is shown and referenced $d_v$ for the button 52-1. Moreover, it is preferable for the control members 52 to be each situated at an absolute distance from the validation member 54 that is less than 1.3 m, more preferentially less than 1 m: this distance is shown and referenced d for the button 52-1.

In the example illustrated, all the control members 52 are arranged on the right-hand side with respect to the handle 70. Because of this, the auxiliary control station 50 is designed to grip the handle 70 and to actuate the validation member 54 with the left hand and to simultaneously actuate any of the control members 52 with the right hand. This arrangement may be reversed. Alternatively, all the control members 52 may be arranged above the handle 70 or vice versa. In any event, it is preferable to arrange all the control members 52 on the same side—lateral or in height—of the handle 70 in order to avoid the operator having to cross his arms or change hand in order to access the various control members 52.

Naturally, the auxiliary control station may comprise other members such as a member or switch 56 for starting the aerial work platform or an emergency stop button 58, as well as display members. It is advantageous for these other members also to be arranged so that the operator can actuate any of them with one hand while he is holding the handle 70 with his other hand.

It is advantageous for the auxiliary control station 50 to be produced in the form of a console 51 preferentially carrying all its components: control members 52, validation member 54, handle 70, etc. This facilitates the mounting of the auxiliary control station 50 on the chassis 2 or turret 4, as well as maintenance thereof. Naturally the general form of the console 51 may be different from the one shown in FIG. 5.

The auxiliary control station 50 may be arranged on the chassis 2 or the turret 4 in a fixed immobile fashion, that is to say without any possibility of change in position.

Alternatively, the auxiliary control station 50 may be mounted thereon so as to be able to be moved by the operator with respect to the chassis 2 or turret 3 according to circumstances.

Figure 8:
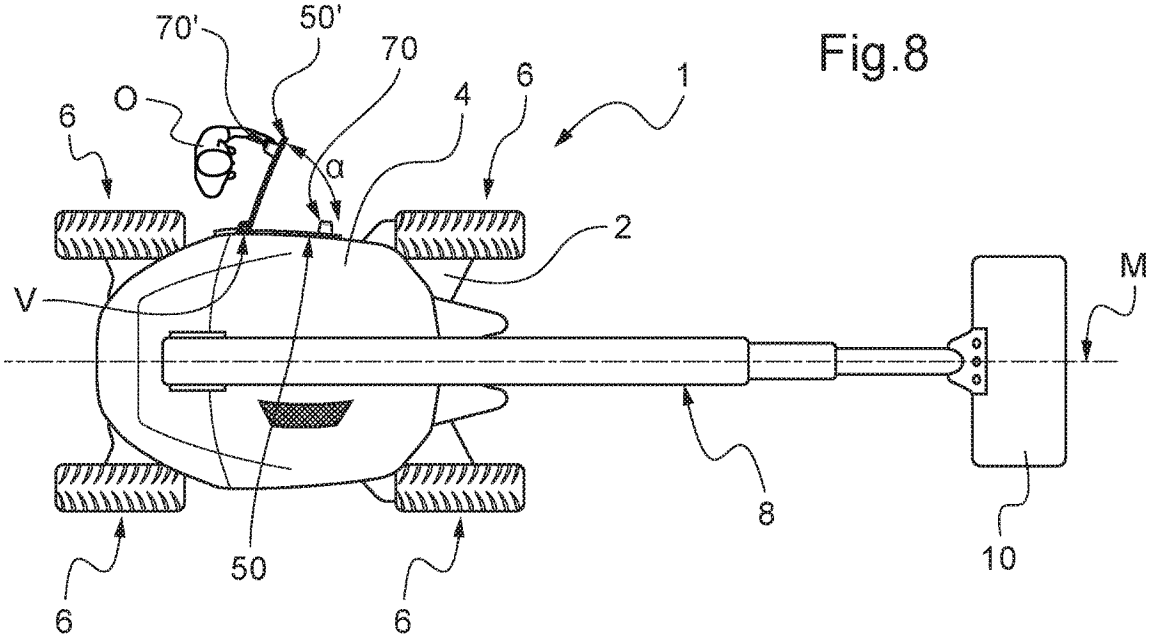
FIG. 8 is a schematic plan view of an aerial work platform illustrating a method of mounting the auxiliary control station on the aerial work platform.

FIG. 8 illustrates the case where the auxiliary control station 50—produced in the form of a console—is mounted so as to be able to pivot about a vertical axis V on the turret 4 or chassis 2 according to circumstances, preferably on a lateral side thereof. The auxiliary control station 50 can be moved between two extreme positions. In the first extreme position, the auxiliary control station and the handle thereof are referenced 50 and 70 respectively. The auxiliary control station 50 is then aligned therein with the lateral side of the turret 4 or of the chassis 2 according to circumstances, preferably recessed with respect to the external surface of the turret 4 or of the chassis 2.

In the second extreme position, the auxiliary control station and the handle thereof are referenced 50' and 70' respectively. In this position, the auxiliary control station projects with respect to the side of the turret 4 or of the chassis 2 according to circumstances. This position advantageously procures for the operator O better visibility of the work platform 10 and of the lifting mechanism 8 when he stands at the auxiliary control station.

The angular movement between these two extreme positions is referenced α. The angular movement α is preferably at least 30°, more preferentially at least 45°, more advantageously at least 60°. It is preferably 90° at a maximum.

A device for holding the auxiliary control station 50 in position—not shown—enables the operator to manually select the required angular holding position of the auxiliary control station 50 with respect to the turret 4 or to the chassis 2 according to circumstances. This device may be of any suitable type, for example a notched wheel sector, mounted fixed at the axis V, and a rod mounted so as to slide in the console forming the auxiliary control station and cooperating with the notches on the notched wheel sector, the rod being elastically biased towards the notched wheel sector and designed to be able to be actuated manually by the operator in order to modify the angular position of the auxiliary control station.

The handle 70 may advantageously serve to pivot the auxiliary control station 50.

In a variant, the auxiliary control station 50 is divided into two parts, one comprising the handle 70 and the validation member 54, which are mounted fixed and immobile on the chassis 2 or the turret 4 according to circumstances, and the other part being made in the form of a console carrying in particular the control members 52 and which is mounted so as to pivot on the chassis 2 or on the turret 4 according to circumstances, as described previously with reference to FIG. 8.

Figure 9:
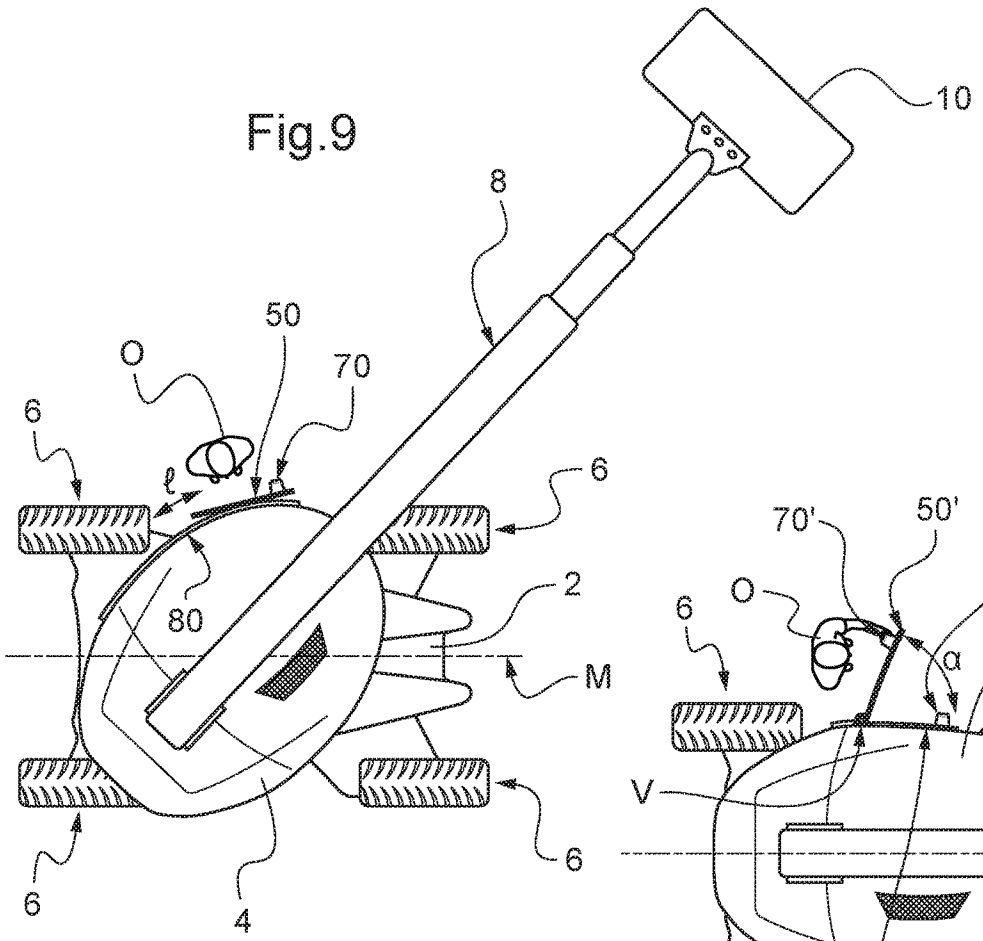
FIG. 9 is a schematic plan view of an aerial work platform illustrating another method of mounting the auxiliary control station on the aerial work platform.

FIG. 9 illustrates another method of mounting the auxiliary control station 50 on the turret 4. The auxiliary control station 50—produced in the form of a console—is here mounted so as to slide horizontally on one side of the turret 4, preferably a lateral side thereof. The sliding takes place substantially parallel to the external surface of this side of the turret 4. This sliding mounting can be implemented by means of rails 80 fixed to the side of the turret 4 and on which the auxiliary control station 50 slides. By virtue of this possibility of sliding, the operator can advantageously move the auxiliary control station 50 into a more conveniently accessible position, having regard to the angular position of the turret 4 with respect to the chassis 2 and more particularly with respect to the wheels 6, which may according to circumstances interfere with access to the auxiliary control station 50. This situation is illustrated in FIG. 8, where the turret 4 is pivoted with respect to the chassis 2, that is to say the beams constituting the lifting mechanism 8 are not aligned with the longitudinal mid-plane M of the chassis 2, unlike the case shown in FIG. 7.

It is preferable also to provide a device for holding the auxiliary control station 50 in position—not shown—to enable the operator to manually select the required horizontal holding position of the auxiliary control station 50 with respect to the turret 4. This device may be of any suitable type, for example a rack mounted fixed on the turret 4 and a rod mounted so as to slide in the console forming the auxiliary control station and cooperating with the notches on the rack, the rod being elastically biased towards the rack and designed to be able to be actuated manually by the operator. There also, the handle 70 may serve to slide the auxiliary control station 50.

The two methods of mounting the auxiliary control station 50 described with reference to FIGS. 8 and 9 may be combined. By way of example, the console forming the auxiliary control station 50 may be mounted so as to pivot about a vertical axis on a chassis, which is itself mounted so as to slide horizontally on one side of the turret 4. A respective device for holding in position may also advantageously be provided for holding the auxiliary control station 50 in the angular position and the horizontal position wished by the operator.

In these various methods of mounting the auxiliary control station 50 that make it possible to modify the positioning thereof with respect to the chassis 2 or the turret 4, the electrical connections between the auxiliary control station 50 and the chassis 2 or turret 4 may be made with one or more flexible electrical cables or a cluster of flexible electrical cables.

Naturally the present invention is not limited to the examples and embodiment described and depicted, but is capable of numerous variants accessible to a person skilled in the art.

It will be understood that the possibilities of pivoting and sliding of the auxiliary control station 50 described with reference to FIGS. 8 and 9 are independent of the ability to grip the handle 70 and to simultaneously actuate the validation member 54 with the same hand, or even independent of the existence of such a handle 70 and/or of a validation button on the auxiliary control station 50. Thus, according to another aspect, the invention proposes an aerial work platform comprising:

- a chassis,
- optionally a turret mounted pivotably on the chassis,
- a work platform,
- a mechanism for lifting the work platform that is mounted on the chassis or where applicable on the turret, and
- a control console comprising manually actuated control members for controlling the lifting mechanism of the work platform and optionally the rotation of the turret, wherein the console is mounted on the chassis or on the turret so as to be able to be moved by the operator with respect thereto.

In particular, the console may be mounted so as to be able to pivot about an axis vertical to the chassis or to the turret to make it possible to change the angular position of the console with respect to the chassis or turret. Alternatively or additionally, the console is mounted so as to slide horizontally on the turret. A device for holding the console in position may be provided, making it possible to manually select an angular and/or horizontal position of holding the console with respect to the chassis or turret.

The invention claimed is:

1. An aerial work platform comprising:

- a chassis;
- a work platform;
- a lifting mechanism adapted to lift the work platform, the lifting mechanism being is mounted on the chassis or on a turret mounted pivotably on the chassis; and
- a control station arranged on the chassis or the turret, said control station comprising:
  - manually actuated control members adapted to control the lifting mechanism of the work platform or adapted to control the lifting mechanism of the work platform and the rotation of the turret;
  - a manually actuated validation member, the control members being inhibited in the absence of simultaneous actuation of the validation member; and
  - a gripping handle;

wherein the arrangement of the manually actuated validation member and of the gripping handle relative to one another makes it possible to hold the gripping handle and to simultaneously actuate the manually actuated validation member with the same hand.

2. The aerial work platform according to claim 1, wherein the mutual arrangement of the manually actuated control members, of the gripping handle and of the manually actuated validation member enables a same operator to simultaneously hold the gripping handle and to actuate the manually actuated validation member with one of his hands and to actuate any one of the manually actuated control members with his other hand.

3. The aerial work platform according to claim 2, wherein all the control members are placed on a same side of the gripping handle.

4. The aerial work platform according to claim 1, wherein the control station is arranged on a lateral side of the chassis or of the turret, wherein the control station extends substantially vertically and the manually actuated control members are each situated:

at a horizontal distance ($d_h$) from the manually activated validation member that is less than 1.3 m;

at a vertical distance ($d_v$) from the validation member that is less than 1 m; and at a distance (d) from the validation member that is less than 1.3 m.

5. The aerial work platform according to claim 1, wherein the distance between the manually activated validation member and a gripping part of the gripping handle is less than or equal to 6 cm.

6. The aerial work platform according to claim 1, wherein the chassis is mounted on running members allowing the aerial work platform to move on the ground.

7. The aerial work platform according to claim 1, wherein:

the control station is arranged on a lateral side of the chassis or of the turret, the control station extending substantially vertically, and the manually actuated control members are each situated:

at a horizontal distance from the manually actuated validation member that is less than 1 m;

at a vertical distance from the manually actuated validation member that is less than 0.7 m, and at a distance from the manually actuated validation member that is less than 1 m.

8. An aerial work platform comprising:

a chassis;

a work platform;

a lifting mechanism adapted to lift the work platform, the lifting mechanism being mounted on the chassis or on a turret mounted pivotably on the chassis; and a control station arranged on a lateral side of the chassis or of the turret and extending substantially vertically, said control station comprising:

manually actuated control members adapted to control the lifting mechanism of the work platform or adapted to control the lifting mechanism of the work platform and the rotation of the turret;

a manually actuated validation member, the control members being inhibited in the absence of simultaneous actuation of the validation member; and a gripping handle, wherein:

the manually actuated control members are mounted on a console, and the arrangement of the manually actuated validation member and of the gripping handle relative to one another makes it possible to hold the gripping handle and to simultaneously actuate the manually actuated validation member with the same hand.

9. The aerial work platform according to claim 8, wherein the console is mounted so as to pivot about a vertical axis on the chassis or on the turret so as to make it possible to change the angular position of the console with respect to the chassis or to the turret.

10. The aerial work platform according to claim 9, comprising a device for holding the console in position making it possible to manually select an angular position of the console with respect to the chassis or to the turret in which the device holds the console.

11. The aerial work platform according to claim 9, wherein the manually actuated validation member and the gripping handle are also mounted on the console.

12. The aerial work platform according to claim 8, wherein the manually actuated validation member and the gripping handle are also mounted on the console and the console is mounted so as to slide horizontally on the turret.

13. The aerial work platform according to any claim 12, comprising a device adapted to hold the console in position which makes it possible to manually select a horizontal position of the console with respect to the turret in which the device holds the console.

14. The aerial work platform according to claim 8, wherein the manually actuated validation member and the gripping handle are also mounted on the console, the console being mounted so as to pivot about a vertical axis on the turret so as to make it possible to change the angular position of the console with respect to the turret and the console being further mounted so as to slide horizontally on the turret.

15. The aerial work platform according to claim 14, comprising a device adapted to hold the console in position making it possible to manually select an angular position and a horizontal position of the console with respect to the turret in which the device holds the console.

16. An aerial work platform comprising:

a chassis, a work platform, a lifting mechanism adapted to lifting the work platform, the lifting mechanism being mounted on the chassis or on a turret mounted pivotably on the chassis, and a control station arranged on the chassis or the turret, said control station comprising:

a gripping handle, a push button arranged on the gripping handle, and manually actuated control members adapted to control the lifting mechanism of the work platform or adapted to control the lifting mechanism of the work platform and the rotation of the turret, the manually actuated control members being inhibited in the absence of simultaneous actuation of the push button, wherein the arrangement of the push button and of the gripping handle relative to one another makes it possible to hold the gripping handle and to simultaneously actuate the push button with the same hand.

17. The aerial work platform according to claim 16, wherein the push button is arranged on the top of the gripping handle towards one end thereof.

18. The aerial work platform according to claim 16, wherein:

the control station is arranged on a lateral side of the chassis or of the turret, the control station extending substantially vertically, and the manually actuated control members are each situated:

at a horizontal distance from the push button that is less than 1 m;

at a vertical distance from the push button that is less than 0.7 m, and at a distance from the push button that is less than 1 m.

19. The aerial work platform according to claim 16, wherein the distance between the push button and a gripping part of the gripping handle is less than or equal to 6 cm.

20. The aerial work platform according to claim 16, wherein the chassis is mounted on running members for allowing the aerial work platform to move on the ground.

* * * * *